United States Patent [19]

Benson

[11] 4,119,253

[45] Oct. 10, 1978

[54] METHOD AND APPARATUS FOR CONTROLLING THE ADVANCEMENT OF A STRAND

[75] Inventor: Gustav E. Benson, Newark, Ohio

[73] Assignee: Owens-Corning Fiberglas Corporation, Toledo, Ohio

[21] Appl. No.: 807,950

[22] Filed: Jun. 20, 1977

[51] Int. Cl.[2] ..... B65H 17/32

[52] U.S. Cl. ..... 226/7; 226/97; 226/113; 226/195

[58] Field of Search ..... 226/7, 97, 195, 113, 226/118

[56] References Cited

U.S. PATENT DOCUMENTS

| | | | |
|---|---|---|---|
| 3,502,253 | 3/1970 | Van Mullekom | 226/113 X |
| 3,669,328 | 6/1972 | Castelli | 226/97 |

*Primary Examiner*—Richard A. Schacher

*Attorney, Agent, or Firm*—Ronald C. Hudgens; Philip R. Cloutier; Greg Dziegielewski

[57] ABSTRACT

Method and apparatus are provided for controlling the advancement of a strand by directing a fluid along the strand in a first direction opposite to the direction of advancement of the strand to retard the advancement of the strand sufficiently to create slack in the strand, and directing a fluid in a second direction transverse to the first direction to control slack in the strand.

10 Claims, 5 Drawing Figures

METHOD AND APPARATUS FOR CONTROLLING THE ADVANCEMENT OF A STRAND

BACKGROUND OF THE INVENTION

There are a number of systems for controlling the advancement of a strand, each system having its characteristics and limitations. In high speed production of bulked or texturized yarns, the systems for controlling the advancement of a strand to the texturizing jet can significantly affect the type of texturized yarns produced.

For example, it has been found that by locating a strand advancement control unit, which will be described later on, between the texturizing jet and the large diameter feed roll of the type of strand advancing means having a pair of coaxial multiple diameter feed rollers which are in a fixed, pre-determined position in relation to the inlet and outlet orifices of the texturizing jet, a bulky yarn having randomly located slubbed portions along the length thereof can be produced. U.S. Pat. No. 3,411,287, issued Nov. 19, 1968, describes a strand advancing means having two multiple diameter feed rollers which are in fixed in pre-determined position in relation to the inlet and outlet orifices of the fluid jet and are driven at high speed with the untexturized yarn being wrapped around and between the large diameter surfaces to feed the jet and the small diameter surfaces on the feed rollers to withdraw the yarn from the texturizing jet.

To control the amount of overfeed supplied to the texturizing unit, the yarn advancing from the large diameter feed roller is passed through a pair of rigidly located guide eyes. Intermediate such guide eyes, a third guide eye is fastened to the piston of a dual acting air cylinder. In the "rest" position the strand is permitted to pass along a straight path between the feed roller and texturizing jet through the guide eyes. The air cylinder can be energized to slowly withdraw, or deflect, the effect yarn from the straight, or primary, path and thus reduce the amount of overfeed of the effect yarn entering the texturizing jet. Then the air cylinder can be reversed to quickly move the third guide eye back to the "rest" position to permit the portion of strand accumulated, or deflected, from the primary path to enter the texturizing jet as a sudden increase in overfeed and thus produce a slubbed region along the length of the texturized strand.

In such a system a portion of the overfeed of the effect yarn is accumulated and released to produce slubbed regions along the length of the texturized yarn.

In an effort to further modify the system, the present invention provides a unit for fluidically controlling the advancement of the effect yarn entering the texturizing jet.

SUMMARY OF THE INVENTION

This invention pertains to a method for controlling the advancement of a strand by directing a fluid along the strand in a first direction opposite the direction of advancement of the strand to retard the advancement of the strand sufficiently to create slack in the strand, and directing the fluid in a second direction transverse to the first direction to control the slack in the strand.

Futhermore, this invention provides apparatus for controlling the advancement of a strand comprising means for directing a fluid along the strand in a first direction opposite the direction of advancement of the strand to retard the advancement of the strand sufficiently to create slack in the strand, and means for directing the fluid in a second direction transverse to the first direction to control the slack in the strand.

It is an object of this invention to provide a system for fluidically controlling the advancement of a strand.

Another object of the invention is to provide a means for controlling the overfeed of the effect yarn of fibrous glass being delivered to the texturizing jet.

DETAILED DESCRIPTION OF THE INVENTION

Figure 1:
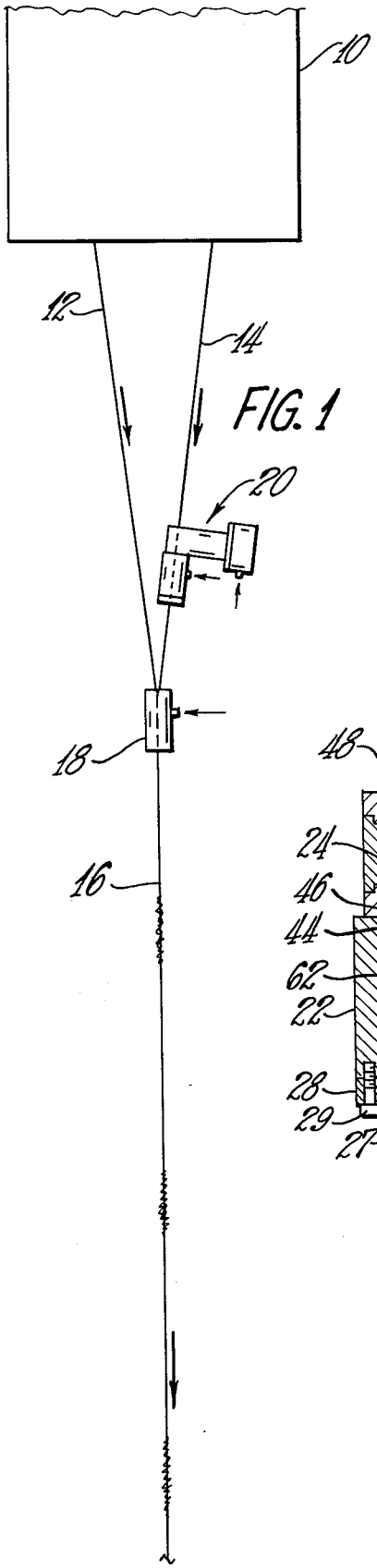
FIG. 1 is a schematic view of a yarn texturizing unit.

As shown in FIG. 1, strand advancing means 10 advances core yarn 12 and effect yarn 14 at substantially constant velocities to texturizing jet 18 to produce texturized yarn 16. Strand advancing means 10 and texturizing jet 18 can be of the type well-known in the art. For the production of a texturized yarn of glass filaments, it is preferred that the strand advancing means 10 be of the type described in U.S. Pat. Nos. 3,488,670 and 3,411,287 and texturizing jet 18 be of the type described in U.S. Pat. Nos. 3,402,446 and 3,381,346 which are hereby incorporated herein.

Control unit 20, located intermediate the feed roll (not shown) of strand advancing means 10 and texturizing jet 18, serves to intermittently accumulate and release a portion of the overfeed of yarn 14 being advanced to texturizing jet 18 to provide a texturized yarn 16 having regions of increased texturization therealong.

As is well-known in the art, the core and effect yarns are fed to the texturizing jet at velocities greater than the velocity of the resulting texturized yarn exiting the texturizing jet. Strand 14 can be advanced to the control unit, or first zone, 20 at a substantially constant first velocity.

Figure 2:
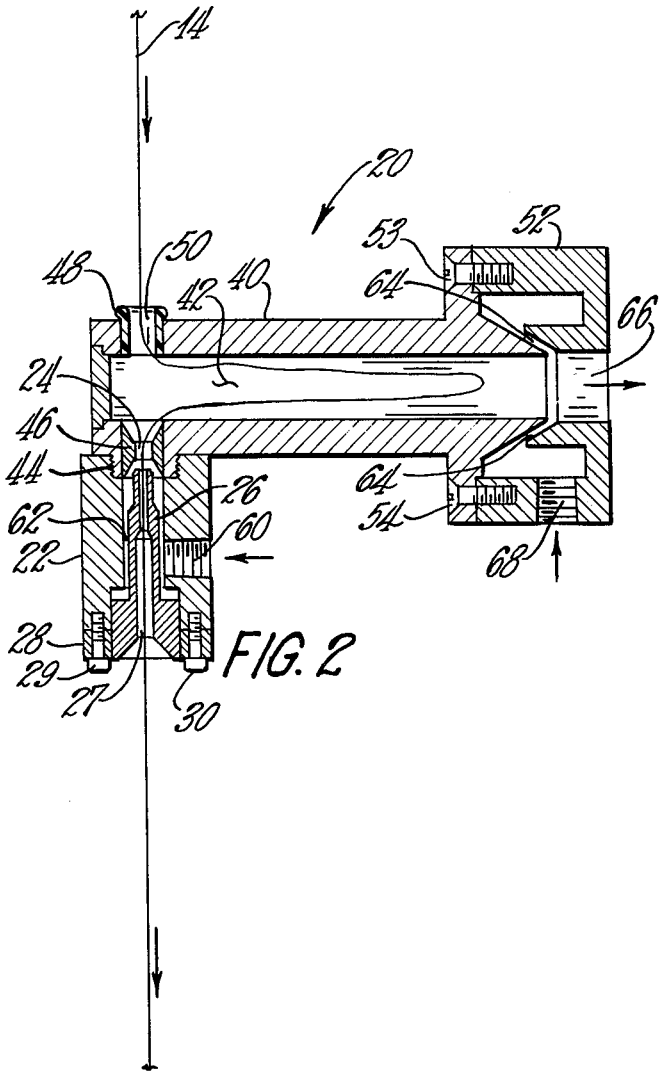
FIG. 2 is a cross-sectional view of the fluidic type control unit for intermittently accumulating and releasing an advancing strand.

As shown in FIG. 2, control unit 20 can be energized to delay or retard a portion of the overfeed of strand 14 and accumulate the slack of the strand formed thereby within the control unit 20.

First member, or body, 22 having a passageway 24 therethrough abuts second member 40 having a passageway 42 at least partially therethrough. Threaded boss 44 having restricted orifice, or venturi member, 46 rigidly located therein, serves to align and rigidly fasten member 22 to member 40 by means of a mating threaded portion located in member 22.

When member 22 is suitably engaged with member 40, passageway 24 extends through venturi 46 in communication with passageway 42. Passageway 42 is transversely disposed with respect to passageway 24. As shown in FIG. 2, passageway 42 is substantially perpendicular to passageway 24, and passageway 42 serves to contain the slack material of strand 14 therein when control unit 20 is energized. Strand entrance 50 can be located coaxially with first passageway 24 to provide an unobstructed, substantially straight path for yarn 14 to follow during the times when control unit 20 is not energized.

Strand entrance 50 can be located on the opposite side of member 40 with respect to venturi 46. Guide eye 48, which is fixed within member 40 at strand entrance 50 can be made of a suitable material, such as Micarta, to reduce the abrasive affects of running contact between the strand and the second member 40.

Strand entrance 50 and venturi 46 is located at one end of passageway 42 and cap 52 is located at the opposite end of passageway 42. Cap 52 is fastened to member 40 by any suitable means such as screws 53 and 54. Member 40 and cap 52 are fabricated to form a passageway 64 in communication with passageway 42. Passageway 64 forms a conical clearance between cap 52 and member 40 and is angled, or disposed, to direct a stream of fluid, such as air, away from the passageway 24 through exhaust port 66 in cap 52. The fluid can be supplied to passageway 64 via supply port 68 in communication therewith and located in cap 52. The supply of pressurized fluid, or air, is not shown.

Elongated needle 26 is rigidly held in place in passageway 24 by means of cap section 28 and suitable fasteners such as screws 29 and 30 extending therethrough into member 22. Passageway 27 of needle 26 is coaxially aligned with venturi 46 to provide a passageway through which yarn 14 can travel. The tip of elongated needle 26 extends partially into the conical section venturi 46, and the axes of the venturi 46 and passageway 27 are parallel but can be offset or canted with respect to each other if desired.

Supply port 60 located in member 22 is in communication with passageway 24 by means of passageway 62 formed by the clearance between needle 26 and member 22. When a pressurized fluid, such as air, is delivered to supply port 60 from a suitable source (not shown), member 22 and needle 26 cooperate to direct a stream of air along the length of the strand 14 in contact with the strand in a first direction opposite to the direction of advancement of the strand. The stream of air is sufficient to cause the strand to cave the control unit, or first zone, at a second velocity less than the velocity of the yarn entering the control unit, or first velocity. The degree to which the fluid retards the advancement of the strand depends upon, among other things, the velocity at which the fluid impinges the strand.

The strand entrance orifice 50 can be of such a size that a substantial portion of the stream of fluid flowing through passageway 24 can be caused to flow through passageway 42. With the strand 14 being fed into control unit 20 at a substantially constant first velocity and the strand 14 leaving the control unit at a second velocity less than the first velocity due to the action of the fluid stream upon the strand, a relatively loose segment of strand, or slack, can form within passageway 42. With the stream of fluid and the strand 14 moving therein, the strand can assume a loop type formation within passageway 42 due to the influence of the moving fluid stream upon the slack strand. That is, the slack formed when the control unit 20 is energized is contained and controlled within said unit and is not left free to foul the surrounding machinery and other yarns.

Depending upon various factors such as line speed, running tension, and the amount of strand overfeed, an additional force may be necessary to adequately control the slack created in the strand. To accomplish this, a second stream of fluid, such as air, can be fed through passageway 64. The orientation and location of passageway 64 with respect to passageways 24 and 42 will tend to establish fluid flow from passageway 24 through passageway 42 towards exhaust port 66. Such a fluid flow will have a tendency to urge strand 14 to assume the looped position within passageway 42 when control unit 20 is activated, that is, when pressurized air is supplied to ports 60 and 68.

In producing a texturized yarn having slubbed regions of increased texturization, the effect yarn 14 is advanced to the control unit, or first zone, 20 at a substantially constant first velocity. The control unit 20 is intermittently energized, or supplied with pressurized air, to direct a first stream of fluid along the strand in a first direction through passageway 24 opposite to the direction of advancement of the strand and sufficient in quantity to cause the strand to leave the control unit, or first zone, at a second velocity. To maintain an overfeed situation, the second velocity must be greater than the withdrawal velocity of the yarn from the texturizing jet 18, and the withdrawal velocity must be less than the first velocity. Then, at a region intermediate the strand advancing means 10 and member 22, the stream of fluid is directed in a second direction transverse to the first direction to control the strand accumulating within the housing defining the first zone.

Under the influence of the texturizing jet and the feed rolls (not shown) of strand advancing means 10 which withdraw the strand from texturizing jet 18, the accumulated strand, or slack, strand 14 will be available to provide a momentary increase in the rate of overfeed when the control unit 20 is de-energized.

It is preferred that the action of the control unit 20 upon strand 14 not produce any substantial texturizing affect.

By intermittently supplying the pressurized fluid to the control unit, the strand leaving the control unit is capable of having an exit velocity that varies between the second velocity and a third velocity which is greater than the first velocity. That is, the amount of overfeed yarn 14 can vary between a second amount of overfeed which is less than the first amount of overfeed entering control unit 20, and a third amount of overfeed which is greater than the first amount of overfeed entering the control unit 20.

Figure 3:
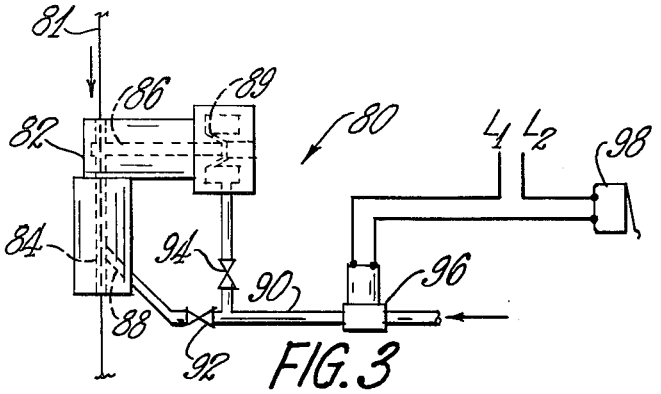
FIG. 3 is a schematic view of another embodiment of the control unit including the fluid supply system.

FIG. 3 depicts an alternative embodiment of the present invention including a means for intermittently supplying the working fluid for energizing control unit 80. As shown, strand 81 passes through first passageway 84 extending through housing 82. Second passageway 86 is in communication with first passageway 84 and extends at least partially through housing 82. Second passageway 86 is disposed transversely with respect to first passageway 84. Third passageway 88 is in communication with passageway 84, and is spaced from passageway 86. Third passageway 88 is obliquely oriented with respect to passageway 84 to direct a first stream of fluid through passageway 84 towards second passageway 86, thereby directing the first stream of fluid along the length of the advancing strand 81 but in a direction opposite to the direction of advancement strand 81. Fourth passageway 89 is in communication with a second passageway 86 and is spaced from the first passageway 84. Passageway 89 is obliquely oriented with respect to passageway 86 to direct a second stream of fluid through passageway 86 but away from passageway 84.

Conduit 90 is connected to passageways 88 and 89, and solenoid operated valve 96. Valves 92 and 94 control the flow rate of the working fluid delivered to passageways 88 and 89 respectively.

Solenoid valve 96 is connected to a suitable source of pressurized fluid, such as air, (not shown). Solenoid valve 96 can be electrically interconnected to a suitable power source via leads L1 and L2. Bump switch 98 which is interconnected with lead L2 serves to intermittently energize solenoid valve 96 to intermittently supply the working fluid to control unit 80. Bump switch 98 can be activated by a conventional bump wheel (not shown) known in the art.

During operation, passages 88 and 84 cooperate to provide a stream of fluid opposed to the advancement of strand 81 to retard the advancement thereof, and to create a slack segment therein. Passageways 89 and 86 cooperate to provide a second stream of fluid to urge the first stream of fluid and strand 81 contained therein into passageway 86 to control and contain the slack portion of strand 81 during the periods that the working fluid is supplied to the control unit.

Figure 4:
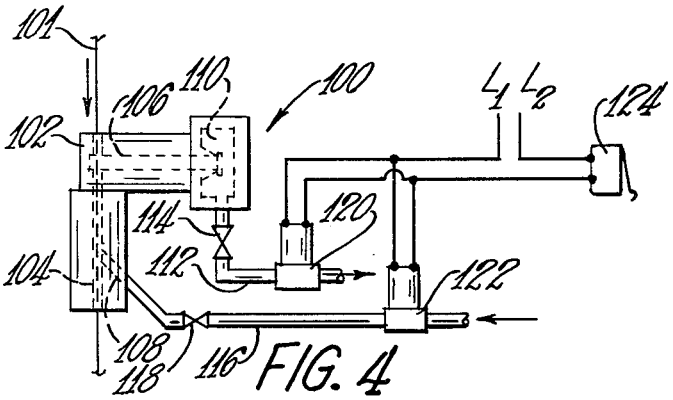
FIG. 4 is a schematic view of another embodiment including the fluid supply system.

As shown in FIG. 4, strand 101 moves through first passageway 104 of housing 102 of control unit 100. Passageway 104 can extend completely through housing 102. Second passageway 106 is in communication with first passageway 104, and second passageway 106 is disposed transversely with respect to first passageway 104. As shown in FIG. 4, passageway 106 is substantially perpendicular to passageway 104. Third passageway 108 in housing 102 is in communication with first passageway 104 and is disposed obliquely thereto to direct a stream of working fluid through passageway 104 towards passageway 106 to retard the advancement of strand 101 and create a slack segment therein.

Fourth passageway 110 is in communication with passageway 106 and is spaced from 104. Conduit 116 cooperating with valve 118 is connected to passageway 108 and solenoid operated valve 122. Solenoid operated valve 122 can be connected to a suitable source of pressurized air (not shown). Conduit 112 cooperating with valve 114 is connected to chamber 110 and solenoid operated valve 120. Solenoid operated valve 120 can be connected to a suitable source of vacuum (not shown).

Leads L1 and L2 can be electrically interconnected with bump switch 124 and solenoid operated valves 120 and 122 to intermittently provide a stream of air to passageway 104 to intermittently retard the advancement of strand 101 and to form a slack segment therein. Simultaneously, passageway 110 is evacuated through conduit 112 and valve 120 to urge the air flowing through passageway 104 through passageway 106 thereby drawing the slack segment of strand 101 into passageway 106 to control and contain the strand therein. During the periods that the solenoid valves are de-energized, the accumulated strand in passageway 106 is capable of being withdrawn from the control unit and then fed into a suitable texturizing jet.

Figure 5:
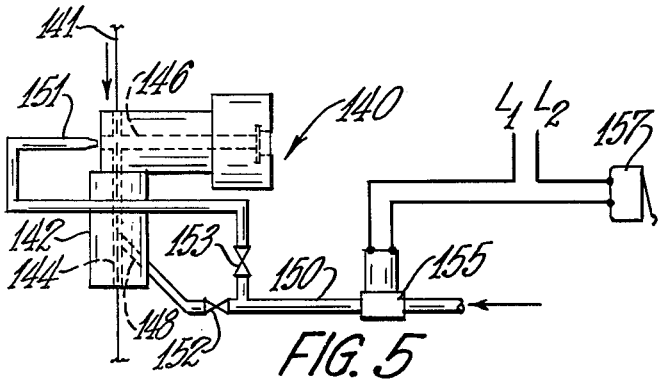
FIG. 5 is a schematic view of yet another embodiment including the fluid supply system.

As shown in FIG. 5, strand 141 passes through first passageway 144 of housing 142. Second passageway 146 extends completely through housing 142 and is disposed transversely to passageway 144 and is in communication therewith.

Third passageway 148 located in housing 142 is in communication with passageway 144 and is oriented obliquely with respect to passageway 144 to direct a stream of air to passageway 144 towards passageway 146, the stream of air having sufficient force to retard the advancement of strand 141 and form a slack segment therein.

Conduit 150 is connected with the third passageway 148, and valve 152 cooperating with conduit 150 serves to control the flow of air to passageway 148. Conduit 150 is also connected to valve 153 which is connected to nozzle 151. Nozzle 151 is disposed to provide a second stream of air through passageway 146 sufficient to urge the strand 141 into passageway 146 during the periods when control unit 140 is energized. Thus, the accumulated slack of strand 141 is controlled and contained within housing 142 at passageway 146. Similar to FIG. 3, conduit 150 is connected to solenoid operated valve 155 which can be suitably connected to a source of pressurized air (not shown). Solenoid operated valve 155 is connected with a suitable source of power through leads L1 and L2 and bump switch 157 which can be activated by a bump wheel (not shown).

It is apparent that, within the scope of the invention, modifications and different arrangements can be made other than as here and disclosed. The present disclosure is merely illustrative with the invention comprehending all the variations thereof.

I claim:

1. The method of controlling the advancement of a strand comprising:

directing a first stream of fluid along the strand through a first passageway in a first direction opposite the direction of advancement of the strand to retard the advancement of the strand and to create slack in the strand, and directing said stream of fluid through a second passageway oriented transversely lengthwise with respect to the first passageway in a second direction transverse to the first direction in the absence of another stream of fluid urging said strand into said second passageway sufficient to control the slack in the strand in said second passageway.

2. The method of claim 1 wherein the strand is advanced at a substantially constant first velocity to a first zone;

the first stream of fluid is directed along the strand to cause the strand to leave the first zone at a second velocity less than the first velocity; and the first stream of fluid is directed in the second direction to control the slack accumulating at the first zone.

3. The method of claim 2 further comprising intermittently supplying said first stream of fluid such that the strand leaving the first zone is capable of having an exit velocity that varies between the second velocity and a third velocity greater than the first velocity.

4. The method of controlling the amount of overfeed of a strand being supplied to a texturizing jet comprising:

supplying the strand at a substantially constant first velocity to a first zone, the strand leaving the texturizing jet having a withdrawal velocity less than the first velocity;

directing a first stream of fluid along the strand in a first direction opposite to the direction of advancement of the strand through a first passageway sufficient to cause the strand to leave the first zone at a second velocity less than the first velocity but greater than the withdrawal velocity; and then directing the first stream of fluid in a second direction transverse to the first direction through a second passageway oriented transversely lengthwise with respect to the first passageway in the absence of another stream of fluid urging said strand into said second passageway sufficient to control the strand accumulation at the first zone in said second passageway, the strand being advanced from the first zone to the texturizing jet.

5. The method of claim 4 further comprising intermittently supplying said stream of fluid such that the strand leaving the first zone is capable of having an exit velocity that varies between the second velocity and a third velocity greater than the first velocity.

6. Apparatus for controlling the advancement of a stand comprising:

means for directing a first stream of fluid along the strand in a first direction opposite the direction of advancement of the strand through a first passageway to retard the advancement of the strand and to create slack in the strand; and means for directing said stream of fluid in a second direction transverse to the first direction through a second passageway oriented transversely lengthwise with respect to the first passageway in the absence of another stream of fluid urging the strand into said second passageway sufficient to control the slack in the strand in said second passageway.

7. The apparatus of claim 6 further comprising:

a means for supplying the strand at a substantially constant first velocity to a first zone;

wherein said means for directing a first stream of fluid along the strand causes the strand to leave the first zone at a second velocity less than the first velocity; and wherein said means for directing the first stream of fluid in a second direction causes the slack to accumulate at the first zone.

8. The apparatus of claim 7 further comprising a means for intermittently supplying said first stream of fluid such that the strand leaving the first zone is capable of having an exit velocity that varies between the second velocity and a third velocity greater than the first velocity.

9. Apparatus for controlling the advancement of a strand passing therethrough comprising:

a housing having a first passageway extending therethrough, a second passageway communicating with the first passageway and being disposed transversely thereto, the second passageway extending at least partially through the housing, a third passageway in communication with the first passageway adapted to provide a first stream of fluid through the first passageway toward the second passageway, said first and second passageways being adapted to direct said first stream of fluid through said second passageway in the absence of another stream of fluid urging said strand into said second passageway sufficient to control slack formed in said second passageway due to said stream of fluid retarding the advancement of said strand.

10. The apparatus of claim 9 wherein said second passageway extends only partially through said housing.

* * * * *